US008689718B2

(12) United States Patent
Cichoski

(10) Patent No.: US 8,689,718 B2
(45) Date of Patent: Apr. 8, 2014

(54) RIGID QUICK CONNECT MOORING DEVICE

(76) Inventor: Jeffrey Jerome Cichoski, Saint Louis Park, MN (US)

( * ) Notice: Subject to any disclaimer, the term of this patent is extended or adjusted under 35 U.S.C. 154(b) by 74 days.

(21) Appl. No.: 13/400,101

(22) Filed: Feb. 19, 2012

(65) Prior Publication Data

US 2012/0285359 A1 Nov. 15, 2012

Related U.S. Application Data

(63) Continuation-in-part of application No. 12/660,541, filed on Mar. 1, 2010, now Pat. No. 8,117,980.

(51) Int. Cl.
*B32B 21/00* (2006.01)

(52) U.S. Cl.
USPC ..... 114/230.15

(58) Field of Classification Search
USPC ..... 114/230.15
See application file for complete search history.

(56) References Cited

U.S. PATENT DOCUMENTS

| | | | | |
|---|---|---|---|---|
| 1,094,610 | A | 4/1914 | Steinhauer | |
| 2,526,162 | A | 10/1950 | Schuelke | |
| 4,708,083 | A | 11/1987 | Billings | |
| 4,977,846 | A | 12/1990 | Landa et al. | |
| 5,408,946 | A | 4/1995 | Jones et al. | |
| 6,561,113 | B2 | 5/2003 | Leise | |
| 6,659,033 | B1 * | 12/2003 | Donley | 114/230.15 |
| 6,910,435 | B2 | 6/2005 | Hadcroft et al. | |
| 6,962,122 | B1 | 11/2005 | Bouldin, Jr. | |
| 6,994,047 | B1 | 2/2006 | Pent, III | |
| 7,089,877 | B1 | 8/2006 | Hay | |
| 7,100,527 | B2 | 9/2006 | Munro | |

* cited by examiner

*Primary Examiner* — Edwin Swinehart

(57) ABSTRACT

A rigid mooring system that instantly secures pontoons, float planes, boats, and other forms of craft to a variety of dockage types and consists of two identical, yet separately positioned devices which together moor a craft safely away from the dockage. Barrel plate hinges permanently secure the two devices to the dockage allowing both the devices and the attached craft vertical motion but prohibit parallel or lateral movement. Each device has two reinforced arms coming together to form a right triangle shaped rigid body with one arm projecting further, bending into a curved attaching end.

9 Claims, 4 Drawing Sheets

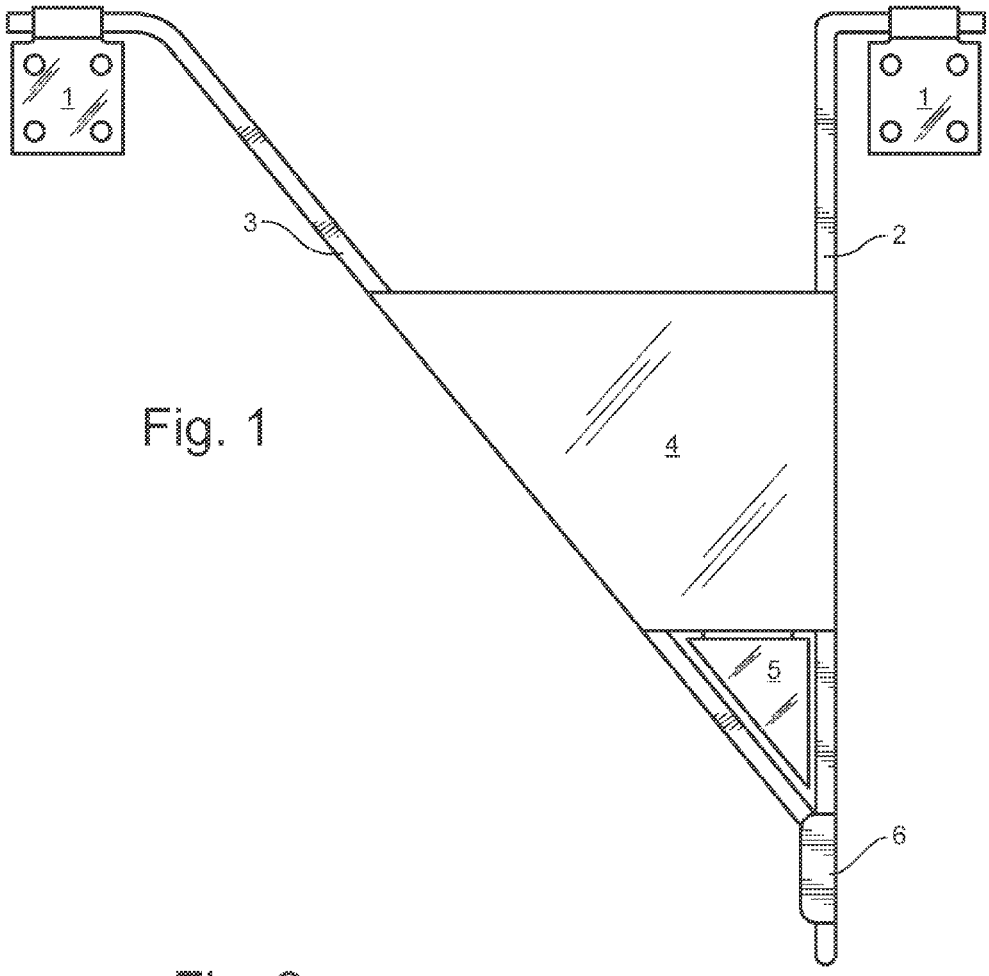
Fig. 1
Fig. 2
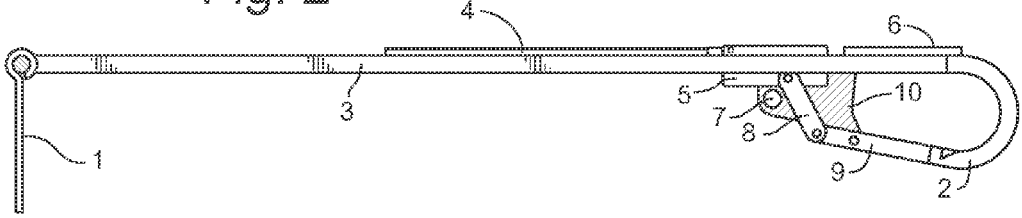
Fig. 3
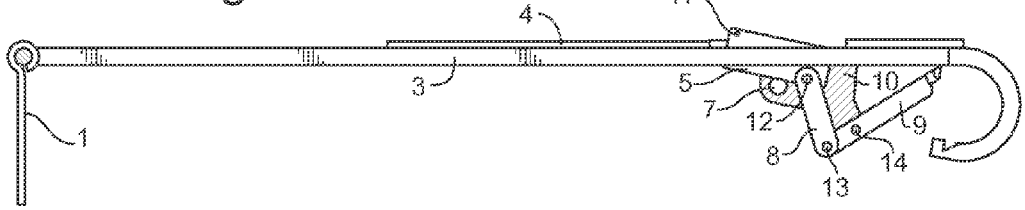

RIGID QUICK CONNECT MOORING DEVICE

This application is a continuation-in-part of U.S. patent application Ser. No. 12/660,541 filed Mar. 1, 2010 (U.S. Pat. No. 8,117,980 issued Feb. 21, 2012) and claims the benefit thereof under 35 U.S.C. §120. U.S. patent application Ser. No. 12/660,541 is hereby incorporated by reference in its entirety into this application.

BACKGROUND

This invention is intended for, but not limited to the watercraft, pontoon, and amphibious aircraft fields. This invention addresses and solves mooring failures and faults including: rope, lashing, and tether failure, ineffective tie down knots, bumper, fender, or pad protection failure, craft damage or loss due to inexperienced mooring knowledge and application, craft damage due to battering against the dockage, loss of craft due to theft, and mooring difficulty caused by wind, rolling water, and other natural conditions. Previous designs such as Hay (U.S. Pat. No. 7,089,877), Billings (U.S. Pat. No. 4,708,083), and Landa et al. (U.S. Pat. No. 4,977,846) require a combination of hard and soft components. Soft components include components that may rot, break, be cut or be displaced. The hard components of previous designs while adequate for lateral restraint may not offer sufficient strength in adverse conditions to hold the forward and backward movement of a craft. Failure in any of these areas may result in extensive damage to the craft and or the dockage. Designs such as Pent, III (U.S. Pat. No. 6,994,047) and Hadcroft et al. (U.S. Pat. No. 6,910,435) when installed create a tripping hazard and or obstruction to pedestrian traffic on the dock. Current designs also fail to address the challenge of speed and ease of use in all types of conditions by novice operators. Other prior art U.S. patents include U.S. Pat. Nos. 6,561,113 to Leise and 7,100,527 to Munro.

SUMMARY

This invention was born out of a need to safely moor a craft with ease quickly and securely by persons of any experience level. Comprised of two identical triangular shaped devices manufactured of steel this system forms a solid connection between the dockage and the craft. Unlike previous designs, each device has two permanent hinged connection points at the dockage and a solid steel connection at the craft forming a reinforced triangle which pivots vertically while holding the craft in place laterally, prohibiting forward or backward movement as well. The barrel plate hinges of this invention are mounted to the side of the dockage keeping the walkway clear, unlike previous systems which pose a tripping threat. This system allows the devices to pivot vertically and rest against the dockage when unused leaving the mooring area and dockage clear, unlike some previous systems which create an impediment for approaching craft and other assorted activities.

The steel connecting points of this system are immune from abrasion wear, rotting, cutting, breaking and bending problems to which other designs using pliable or organic materials are subject. Providing a fixed space between the craft and dock prevents contact damage which eliminates the need for ropes, whips, bumpers, fenders, pads, buoys and other devices which may fail due to loss, inaccurate placement, or unforeseen displacement.

The self closing spring loaded latch instantly opens upon contact grasping the u-bolt, cleat, bow eye or other tie down device on the watercraft. With a push of the release button the craft is freed. After release gravity pivots the devices down to a vertical position against the dock where they remain hanging until needed. These actions are accomplished instantly with minimal effort or experience unlike current systems requiring tying and untying knots, looping ropes, lashings, tethers, insertion and removal of pins and clips, manual clasps and clamps, chaining, etc.

Unlike previous systems these devices also offer the option of being locked with a separate padlock thus preventing theft or unauthorized release of the craft.

DESCRIPTION OF THE DRAWINGS

FIG. 1 illustrates the top view of the invention.

FIG. 2 illustrates the invention in a side view, horizontal position, with the release assembly components in a normal closed position.

FIG. 3 illustrates the invention in a side view, horizontal position, with the release assembly components in the open position.

| LEGEND OF COMPONENTS | |
|---|---|
| 1. | Barrel plate hinges |
| 2. | Primary arm |
| 3. | Brace arm |
| 4. | Main brace plate |
| 5. | Release button |
| 6. | Small brace plate |
| 7. | Lock access opening |
| 8. | Push arm |
| 9. | Latch |
| 10. | Main tang |
| 11. | Release button hinge pin |
| 12. | Push arm pin |
| 13. | Latch pin |
| 14. | Main tang pivot pin |
| 15. | Pivot pin access hole |
| 16. | Hinge pin plate |
| 17. | Latch spring |
| 18. | Spring loaded hinge |
| 19. | Hinge plate |
| 20. | Hinge plate |
| 21. | Hinge pin |
| 22. | Coil spring |
| 23. | End of coil spring |
| 24. | End of coil spring |

DETAILED DESCRIPTION OF THE INVENTION

This invention preferably is to be manufactured entirely of stainless steel for strength and impunity to corrosion. Two of these devices are needed to secure a watercraft as seen in FIG. 9.

Figure 7:
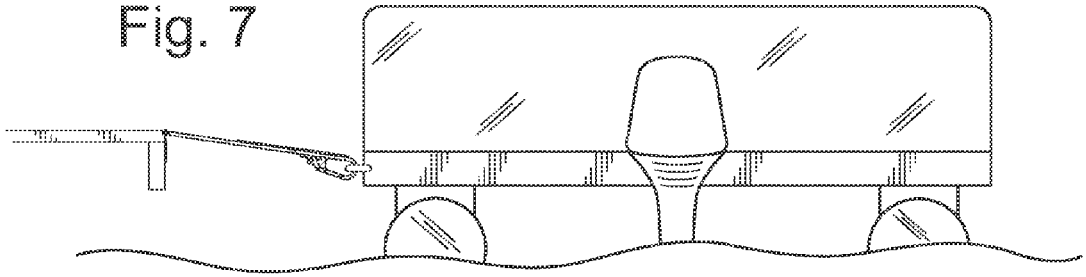
FIG. 7 illustrates this device holding a craft by the craft's u-bolt.
Figure 8:
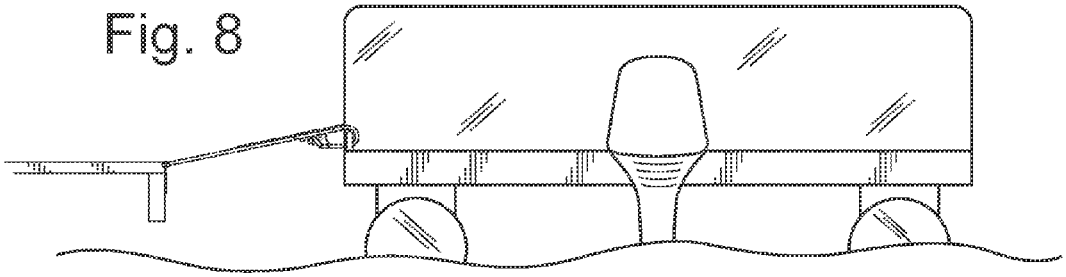
FIG. 8 illustrates this device holding a craft by the craft's bow eye.

The primary arm 2 and brace arm 3 as seen in FIG. 1 and the latch arm 9 in FIG. 2 are round stock. The pins 11, 12, 13, and 14 in FIG. 3 are also round stock. The remaining parts are formed of various thicknesses of flat stock. The preferred connection of non moving parts will be, but not limited to, welding. This invention must be attached to the dock or mooring structure by bolting, screwing, or welding the two pre drilled barrel plate hinges 1 of FIG. 1 to the side of the dock with the hinge barrels positioned horizontally. Mounted in this fashion the barrel hinge plate should be no higher than the dock surface as seen in FIG. 7 so as not to interfere with a smooth dock surface. While the system is in use the barrel plate hinges 1 allow the primary arm 2, and brace arm 3, of FIG. 1, to rotate up and down with the wave action or water level variation. The invention can swing down flat against the dockage when not in use, out of sight and out of the way.

Figure 9:
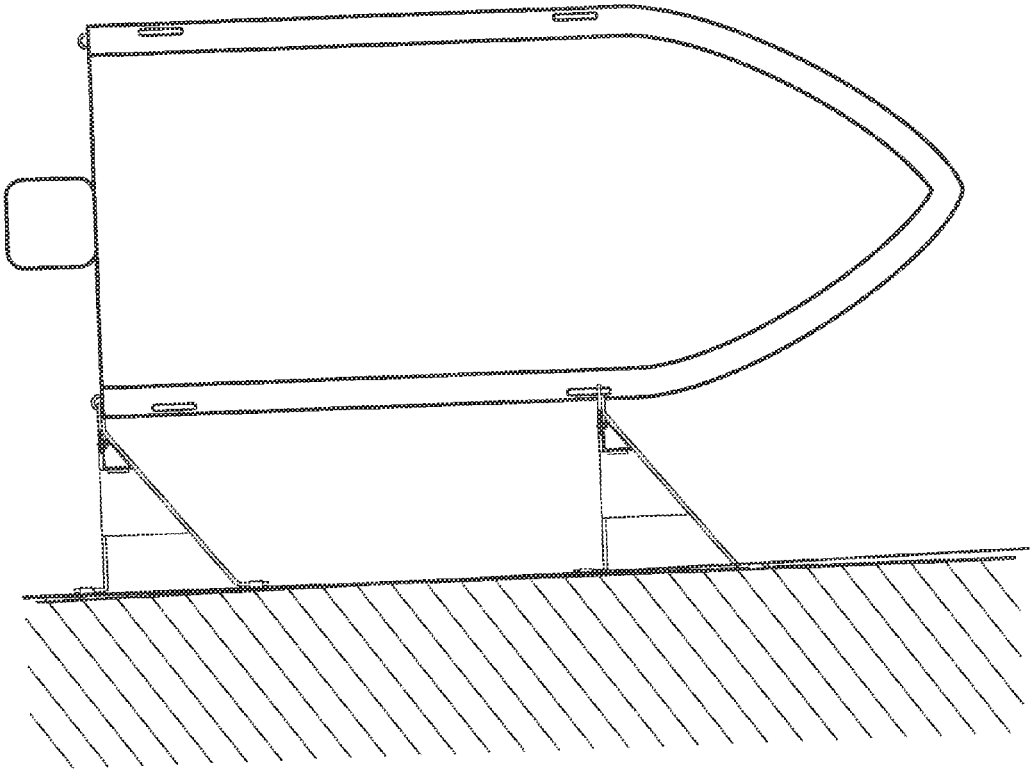
FIG. 9 is an overhead view of the invention holding a craft in place and shows the aft device connecting to a rear u-bolt on the craft, with the forward device connected to a cleat on the craft.

When the craft to be moored draws within arms reach of the dock the invention is swung upwards with one hand, by a person dockside or aboard the craft, then pressed down against the craft's mooring bolt or tie down device instantly securing the craft as seen in FIG. 9.

To make this function happen, the latch 9 of FIG. 3 opens when pressed onto the craft's mooring bolt or tie down device. Constant pressure from the latch spring 17, of FIG. 4, returns the latch 9 to the closed position as shown in FIG. 2 thus securing the craft. Once attached to the craft the primary arm 2, and angled brace arm 3, of FIG. 1, together forming the framework of the device will not let the craft move forward, back, outward or inward. The primary arm 2 and brace arm 3 are reinforced by the main brace plate 4 and the small brace plate 6 which are welded into position as shown in FIG. 1. A lock can be put on the invention thru the lock access opening 7 in the main brace tang 10 shown in FIG. 4. This prevents the release button 5 of FIG. 2 from being depressed making it impossible to open the latch and free the craft.

Figure 4:
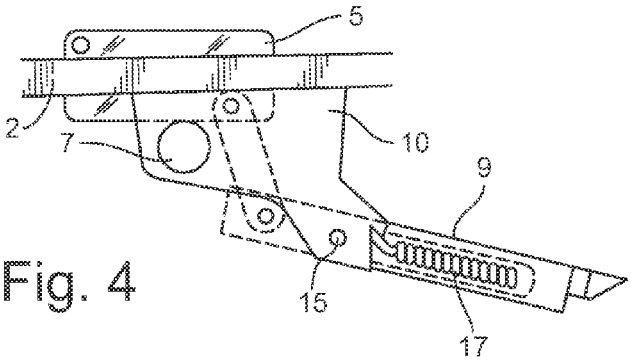
FIG. 4 illustrates a side view of the main tang and its relationship with the release assembly components.
Figure 5:
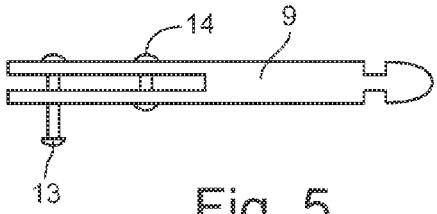
FIG. 5 illustrates a top view of the latch arm and connecting pins.

To release the invention from the moored craft the separate lock, if one has been applied, must first be removed from the lock access 7, shown in FIG. 4. A person on the dockage or aboard the watercraft grasps the outer end of the invention with one hand on the main brace plate 4 and presses the release button 5 which rotates on its hinge pin 11 forcing the push arm 8 down which opens the latch 9, shown in FIG. 3. The hinge pin 11 connects the release button 5 to the hinge pin plate 16 which is welded to the main brace 4 holding all in position, shown in FIG. 6. The push arm 8 serves as the moving connection between the release button 5 and the latch 9, the connecting points being the push arm pin 12 and the latch pin 13, shown in FIG. 3. As shown in FIG. 3, the push arm 8 forces the latch 9 to pivot open on the main tang pivot pin 14 allowing the device to be lifted free of the craft.

Once free of the craft and the craft has cleared, the device is released, the latch spring 17 of FIG. 4 closes the latch and gravity pivots the device down to rest vertically against the side of the dockage until needed.

The rigid, lockable and self closing mooring device, includes: a) the primary arm 2 and the brace arm 3; b) wherein each of the primary arm 2 and brace arm 3 includes a bent base; c) wherein the bent bases of the primary and brace arms 2, 3 are retained in barrel plate hinges 1; d) wherein each of the barrel plate hinges 1 includes an anchored position; e) wherein each of the anchored positions of the barrel plate hinges 1 creates a horizontal pivot axis; f) wherein the primary arm 2 and brace arm 3 meet at a juncture distant from the barrel plate hinges 1 and form a triangular shape; g) the small brace plate 6, wherein the small brace plate 6 is disposed over the juncture; h) wherein the primary arm 2 continues from the juncture in a radius to a primary arm end; i) wherein the primary arm end is milled to interlock with the latch 9; j) the large brace plate 4, wherein the large brace plate 4 joins the primary and brace arms 2, 3; k) the hinge pin plate 16, wherein the hinge pin plate 16 is connected to the large brace plate 4 thereby creating an anchor point; l) a release button assembly on the anchor point, wherein the release button assembly includes the release button 5 connected to the push arm 8 which is connected to the latch 9, wherein the release button 5 under externally applied pressure forces the push arm 8 to open the latch 9; m) the main brace tang 10, wherein the main brace tang 10 is affixed to the primary arm 2, wherein the latch 9 pivots on the pin 14 projecting thru the main brace tang 10; 0) the spring 17 provides continual pressure on the latch 9 to force the latch 9 to integrate with the primary arm 2; p) wherein the continual pressure by the spring 17 also maintains the release button 5 in a ready position; and q) the lock aperture 7 drilled thru the main brace tang 10, wherein the lock aperture 7 is utilized to prohibit operation of the release assembly.

The mooring device further includes a flat plate portion for each of the barrel plate hinges 1. Each of the flat plate portions includes pre drilled mounting holes. Each of the barrel plate hinges 1 fit onto the bent bases of the primary and brace arms 2, 3 and retains the primary and base arms 2, 3 in permanent locations while allowing the retained arms 2, 3 to pivot.

The primary arm 2 includes a length of round stock. The bent base of the primary arm 2 includes a short horizontal anchoring base section. The primary arm 2 further includes a long straight section. The bent base and long straight section are disposed at 90 degrees relative to each other. The long straight section forms one side of a triangular framework of the mooring device. The long straight section continues into a downwardly radius to the primary arm end. The primary arm end is machined to accept the latch 9 in a flush interlocking integration.

The brace arm 3 includes a length of round stock having a short bent section at each end. One of the short bent sections is the bent base of the brace arm 3. The bent sections are on the same plane. The bent sections have bend angles combining to equal 90 degrees. One end of the brace arm 3 is attached to the primary arm 2 and thereby forms an apex of a right triangle. The other end of the brace arm 3 has the bent base. The bent base of the brace arm 3 is on the same linear or straight or rectilinear line as the bent base of the primary arm 2.

The large brace plate 4 includes a fixed position and reinforces the primary arm 2 and the brace arm 3. The fixed position provides a foundation for the release button assembly.

The small brace plate 6 connects the primary arm 2 and brace arm 3 at the juncture.

The latch 9 is machined of a comparable material to, and forms a flush integration with, the primary arm 2, from where the latch 9 continues to the main brace tang 10, at which point the latch 9 is slotted to straddle the main brace tang 10 and to include a slotted end. The slotted end continues to a termination beyond the main brace tang 10. The slotted end is drilled perpendicularly thru to accept the latch pin 13 of the push arm 8 and also is drilled perpendicularly thru to accept the main brace tang pivot pin 14 of the main brace tang 10. The latch 9 is drilled laterally to house the spring 17.

The main brace tang 10 is manufactured of flat stock, is anchored to the primary arm 2, and accepts and guides a swinging motion of the latch 9. The main brace tang 10 also includes drilled apertures, with one drilled aperture being for the main brace tang pivot pin 14 and with one drilled aperture being the lock aperture 7.

The lock aperture 7 in the main brace tang 10 is sized to accept a separate locking device such as a padlock. A padlock is a portable or detachable lock with a pivoted or sliding shackle that can be passed through a link, ring, staple, or opening, such as opening 7. The lock aperture 7 is located to prevent latch movement when the lock aperture 7 is utilized such as by a shackle of a padlock.

The mooring device further includes the main tang pivot pin 14. The main tang pivot pin 14 is a steel pin. The main tang pivot pin 14 is a stationary pivot pin. The main tang pivot pin 14 passes thru the latch 9 and a slot formed in the latch 9 in a direction perpendicular to a length of the latch 9. The main tang pivot pin 14 passes freely thru an access 15 provided in the main brace tang access, thus creating a stationary pivot point for the latch 9.

The mooring device further includes the latch pivot pin 13. The latch pivot pin 13 passes perpendicularly thru a slotted end of the latch 9, continuing freely thru the push arm 8, thereby providing a pivoting connection point for the latch 9 and the push arm 8.

The push arm 8 includes a formed connecting plate having a drilled access hole at either end. One of the drilled access holes freely accepts the latch pivot pin 13 of the latch 9. The other of the drilled access holes freely accepts the push arm pin 12 of the push arm 8, thereby forming a connection between the release button 5 and the latch 9.

The mooring device further includes the push arm pivot pin 12. The push arm pivot pin 12 is mounted to a release button body of the release button 5 and protrudes and passes freely thru the push arm 8, thereby connecting the release button 5 and the push arm 8.

The release button 5 is formed to fit a position between the primary arm 2 and brace arm 3 at an apex of the primary arm 2 and brace arm 3. The hinge pin plate 16 is connected to the large brace plate 4 and the release button hinge pin 11 is connected to the hinge pin plate 16. The release button hinge pin 11 and the push arm pin 12 of the push arm 8 allows the release button 5 to open the latch 9.

The release button hinge pin 11 passes thru one side of the hinge pin plate 16, continues freely thru release button mounting holes formed in the release button 5, then passes thru the other side of the hinge pin plate 16 where the release button hinge pin 11 terminates. The release button hinge pin 11 allows the release button 5 to pivot under pressure.

A release button hinge plate 16 is connected between the release button 5 and the large brace plate 4. The release button hinge plate 16 consists of a formed steel plate attached to the large brace plate 4. The release button hinge plate 16 includes hinge plate sides formed and drilled to accept the release button hinge pin 11.

The spring 17 is positioned within the latch 9 and is compressed against the main brace tang 10 so as to impart constant pressure on the latch 9 to maintain an integrated position with the primary arm 2. The constant pressure on the latch 9 also maintains the release button 5 in a ready position.

Figure 11:
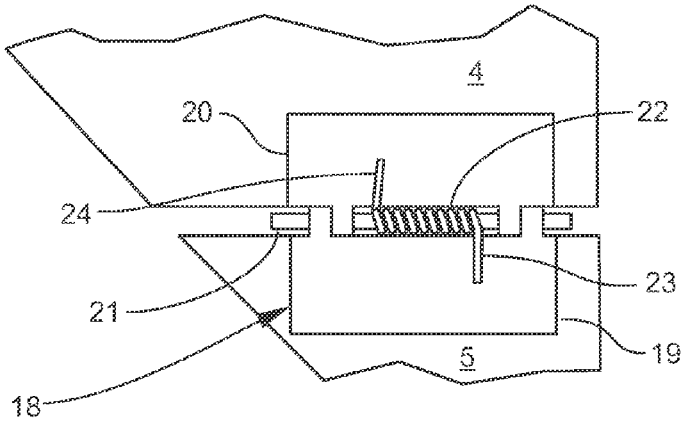
FIG. 11 is a diagrammatic detail view of a spring loaded hinge of the device of FIG. 10.
Figure 10:
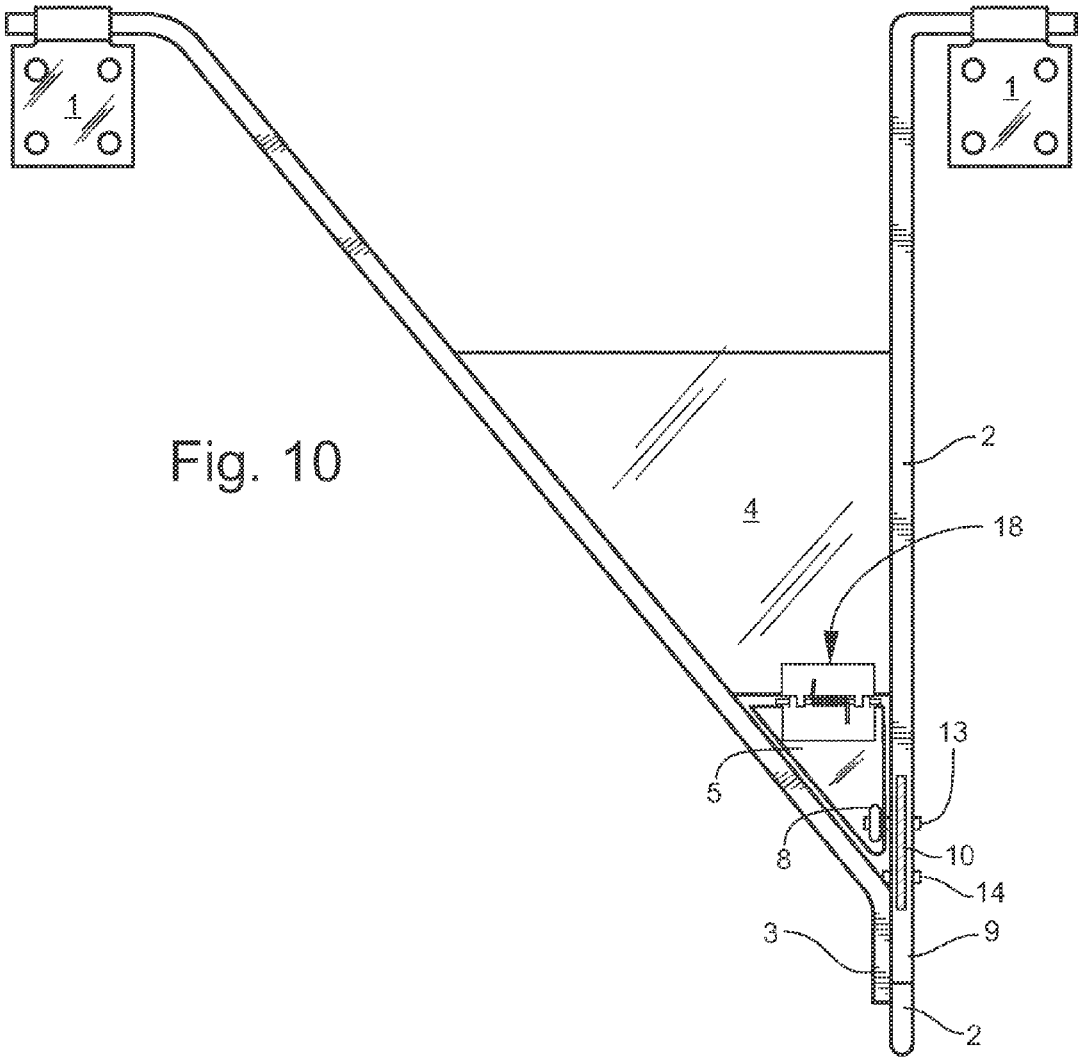
FIG. 10 is an underside view of an alternate embodiment of the device of FIG. 6.

FIGS. 10 and 11 show an alternate embodiment of the present invention that includes a spring loaded hinge 18, a first hinge plate 19, a second hinge plate 20, a hinge pin 21, a coil or coiled spring 22, a first coil spring end 23, and a second coil spring end 24.

Figure 6:
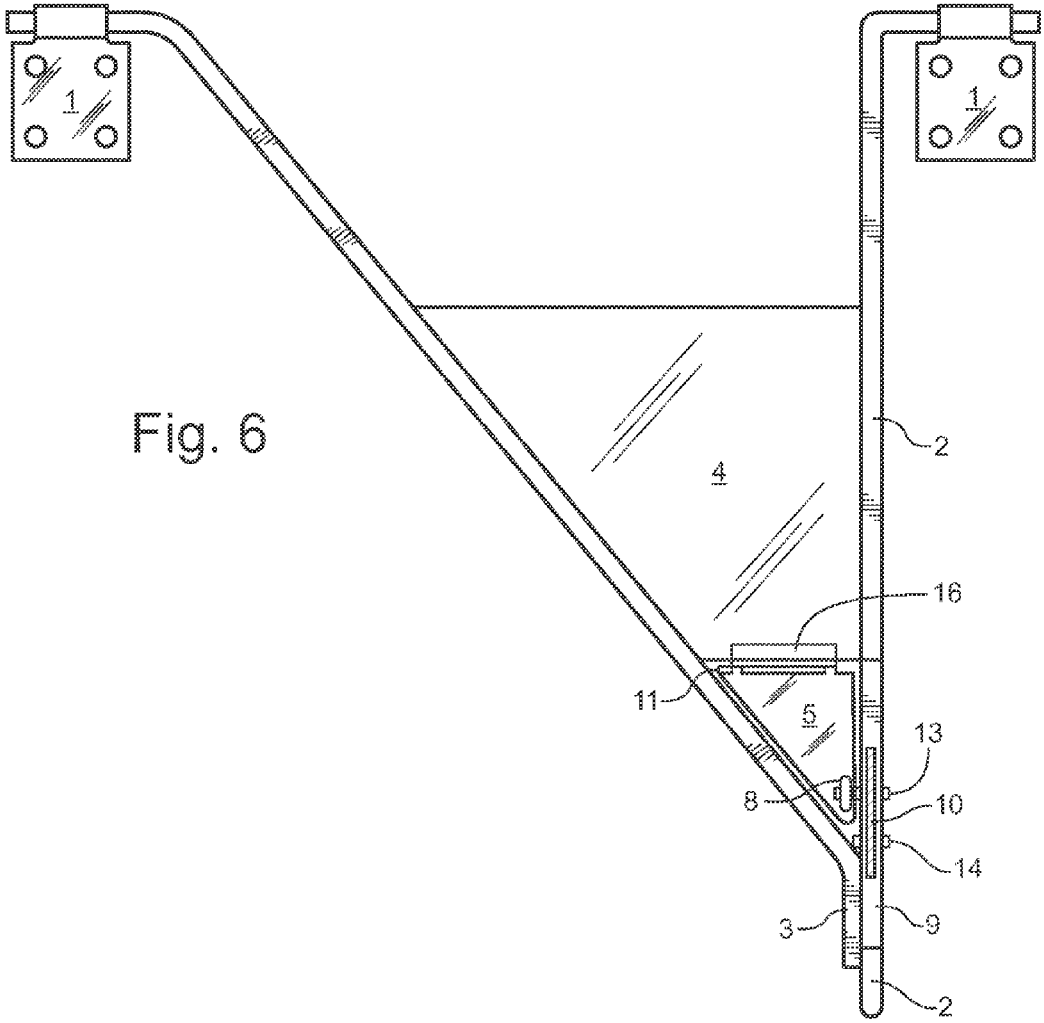
FIG. 6 illustrates the underside view of the device.

In the embodiment of FIGS. 10 and 11, the release button hinge pin 11, hinge pin plate 16, and the latch spring 17 are removed from the structure of the embodiment of FIG. 6. Latch spring 17 is shown in FIG. 4. Instead, a first hinge plate 19 is rigidly fixed to the underside of the release button 5 and a second hinge plate 20 is rigidly engaged to the underside of the main brace plate 4. Hinge pin 21 ties the hinge plates 19, 20 together and permits the release button 5 to pivot or swing relative to the main brace plate 4 along an axis of the pin 21. Engaged on the pin 21 is coil spring 22. Coil or coiled spring 22 may also be referred to as a torsion spring or a door closer spring 22 in that spring 22 includes two ends 23, 24 that bring pressure to bear on the underside of the hinge plates 19, 20 such that release button 5 is normally biased to a closed position. This closed position is where release button 5 lies generally in the same plane as main brace plate 4. Or this closed position is where each of the release button 5 and main brace plate includes an upper or first face and where the respective upper faces are parallel to each other.

The release button 5 includes a proximal end where plate 19 is connected. The release button 5 also includes a distal end. When pressure from above or from the first face is exerted on the distal end, or near the distal end, the release button 5 swings or pivots and such motion activates the push arm 8, which in turn activates or opens the latch 9. As long as pressure is being exerted upon the release button 5, the latch 9 remains in an open position. When pressure is removed from the release button 5 and when release button 5 has returned to its normal or closed position, then latch 9 is also returned to its normal or closed position. The push arm 8 may be referred to as a connection or mechanical train between the release button 5 and the latch 9. Included in this connection train is the pivot connection between the release button 5 and the push arm 8 and the pivot connection between the push arm 8 and the latch 9.

This invention includes a rigid mooring device for engagement between a nonfloating structure such as a dock and a floating structure such as a boat or float plane. These floating structures having a tie down devices such as U-bolts, cleats, or bow eyes as indicated above. The rigid mooring device includes a) a first structure having a proximal end and a distal end, with the proximal end having first and second proximal connections such as the bent portions of the primary and brace arms 2, 3 or such as the hinges 1. The first and second proximal connections 1 are spaced apart from each other. The first and second proximal connections 1 are adapted to be connected to the nonfloating structure. The distal end of the first structure includes a distal connection. This distal connection includes one or more of the latch 9, the hook portion of the primary arm 2, and the combination of the closed loop that is formed by the hook portion of the primary arm 2, the latch 9, and the distal edge of the main tang 10 that is rigidly fixed, such as by welding, to the primary arm 2. The distal connection is adaptable to be connected to any one of many tie down devices of the floating structure such as a U-bolt, cleat, or bow eye. The first structure is rigid from the first and second proximal connections to the distal connection.

The first and second proximal connections include a horizontal axis, such as provided by the bent portions of the primary and brace arms 2, 3 that are received in the hinges 1, such that the first and second proximal connections permit the distal connection, including the hook portion of the primary arm 2, to swing up and down vertically relative to the first and second proximal connections.

The distal connection includes a through hole. The though hole extends horizontally such that the through hole permits the distal connection to swing up and down vertically relative to the tie down structure of the floating structure. This through hole is defined by the inside edge of the latch 9, the distal edge of the main tang 10, and the inside edge of the hook portion of the primary arm 2. This hook or hook portion includes both a curved portion and a rectilinear or straight portion. This hook or hook portion runs from the distal edge of the main tang 10 to the distal end of the latch 9.

The first structure includes a first piece or primary arm 2 that is integral and one-piece from the first proximal connection to the distal connection such that rigidity of said first structure is maximized.

The first piece or primary arm 2 includes the hook or hook portion that is described above.

The first structure includes a latch 9 that closes off the hook to form a closed loop. The closed loop is provided by the distal edge of the main tang 10, the hook or hook portion running from the distal edge of the main tang 10 to the distal edge of the latch 9, and the portion of the latch 9 that runs from the distal end of the latch 9 to the distal edge of the main tang 10.

The first structure includes a second piece or brace arm 3 that is integral and one-piece from the second connection to the first piece or primary arm 2 where the second piece or brace arm 3 is engaged to the first piece or primary arm 2. The first piece or primary arm 2 includes a first axis. The second piece or brace arm 3 includes a second axis. The first and second axes are oblique relative to each other.

The distal connection includes a closed loop as described above. The closed loop includes the latch 9. The latch 9 forms a portion of the closed loop. The latch 9 is biased to a closed position by the latch spring 17 or the spring loaded hinge 18, depending upon the embodiment being employed. The latch 9 is openable when pressure from outside of the closed loop is exerted upon the latch 9 in an inward direction.

The first structure includes a first face and a second face. The first face includes the upper face of the main brace plate 4 and the upper face of the release button 5. The distal connection is on the second face, with the second face including the latch 9, and where the latch 9 interlocks with the hook portion of the primary arm 2. The first structure includes a release or release button 5 and a connection train, such as the push arm 8, between the release 5 and the distal connection. The distal connection includes the latch 9. The release 5, connection train and latch 9 are structured such that operation of the release 5 or pressure on the release button opens the latch 9 and maintains the latch 9 in an open position until operation of the release 5 ceases or until pressure on the release button 5 is removed. As indicated above, the release 5 is on the first face of the first structure.

As shown in FIG. 9, a mooring apparatus includes first and second devices or first and second structures. A mooring device or mooring structure of the present invention is that shown in FIG. 6 or FIG. 10 that includes two proximal connections and a distal connection. The first and second structures are identical such that each of the first and second structure includes a first proximal connection, a second proximal connection, and a distal connection. As shown in FIG. 9, the first and second structures are spaced apart from each other such that the floating structure is engaged at two spaced apart tie down devices.

It should be noted that the horizontal axis provided by the bent portions or bent bases of the primary and brace arms 2, 3 is strictly defined such that minimal play is permitted. On the other hand, the closed loop provided by the latch 9, hook portion of the primary arm 2, and distal edge of the main tang 10 allows some amount of play along the horizontal axis of the through hole or closed loop when the distal connection is engaged to a U-bolt, cleat or bow eye of a craft. This amount of play is limited by making use of two mooring devices as shown in FIG. 9. The closed loop or through hole is somewhat large so as to accommodate a variety of sizes of U-bolts, cleats and bow eyes.

It should be noted that the closed loop provided by the latch 9, hook portion, and distal edge of the main tang 10 is not openable by the inside of a tie down device such as a U-bolt hitting the inner edges of the closed loop, even if the lock aperture is not being utilized. Such inner hitting by, for instance, a portion of a U-bolt, will only force a further interlock between the distal edge of the latch 9 and the end of the hook. Again, it is noted that the main tang 10 is rigidly fixed to the primary arm 2.

It should be noted that the closed loop cannot be opened by pressure upon the latch 9 from outside of the closed loop when the lock aperture 7 is being utilized. This pressure, being exerted on the outer edge of the latch 9, will tend to pivot the distal end of the latch 9 inward, which tends to articulate the push arm 8, which tends to articulate the release button 5, which cannot be articulated because the underside of the release button 5 will hit the shackle that is in the lock aperture 7.

It should be noted that the distal edge of the main tang 10 protects the connection train from forces being exerted inside of the closed loop. Such forces are a banging of portions of a U-bolt, cleat, or bow eye as the craft undulates or rises and falls in a storm.

It should be noted that the connection train prevents the distal end of the release button 5 from swinging upwardly. In other words, when the distal end of the latch 9 interlocks with the hook of the primary arm 2, the push arm 8 is disposed at an end of a swinging motion, which then disposes the release button 5 at an end of a swinging motion and, in such position at the end of this swinging motion, the release button 5 is in its normal or rest position where the upper face of button 5 is in a plane parallel to the upper face of the main brace plate 4.

Though this invention has been described in connection with a preferred embodiment it shall be understood that various renditions, modifications, additions and or alterations may be made to the invention by one skilled in the art without departing from the essence, scope, and spirit of the invention as defined in the appended claims.

I claim:

1. A rigid mooring device for engagement between a nonfloating structure and a floating structure, with the floating structure having a tie down device, with the rigid mooring device comprising:

a) a first structure having a proximal end and a distal end, with the proximal end having first and second proximal connections, with the first and second proximal connections being spaced apart from each other, with the first and second proximal connections being adapted to be connected to the nonfloating structure, with the distal end of the first structure having a distal connection, and with the distal connection having a through hole for accepting a portion of the tie down device of the floating structure;

b) with the first structure being rigid from the first and second proximal connections to the distal connection, and with the first structure including a first piece that is integral and one-piece from the first proximal connection to the distal connection such that rigidity of said first structure is maximized; and c) wherein the distal connection comprises a closed loop, with the closed loop having a latch, with the latch forming a portion of the closed loop, with the latch being biased to the closed position, and with the latch being openable when pressure from outside of the closed loop is exerted upon the latch in an inward direction.

2. The mooring device of claim 1, wherein each of the first and second proximal connections includes a horizontal axis such that the first and second proximal connections permit the distal connection to swing up and down vertically relative to the first and second proximal connections.

3. The mooring device of claim 1, wherein the though hole extends horizontally such that the through hole permits the first and second proximal connections to swing up and down vertically relative to the distal connection.

4. The mooring device of claim 1, wherein the first structure includes a second piece that is integral and one-piece from the second proximal connection to the first piece where the second piece is engaged to the first piece, with the first piece having a first axis, with the second piece having a second axis, and with the first and second axes being oblique relative to each other.

5. The mooring device of claim 1, wherein the first structure includes a first face and a second face, with the distal connection being on the second face, and with the first structure further comprising a release and a connection train between the release and the distal connection, with the distal connection including said latch, with the release, connection train and latch being structured such that operation of the release opens the latch and maintains the latch in an open position until operation of the release ceases, with the release being on the first face.

6. The mooring device of claim 1, wherein the first structure includes a first face and a second face, with the distal connection being on the second face, and with the first structure further comprising a release button and a connection train between the release button and the distal connection, with the distal connection including said latch, with the release button, connection train and latch being structured such that pressure on the release button opens the latch and maintains the latch in an open position until the pressure on the release button is removed, with the release button being on the first face.

7. The mooring device of claim 1, and further comprising a second structure, with the second structure being identical to the first structure such that the second structure also includes a first proximal connection, a second proximal connection, and a distal connection, with the first and second structures spaced apart from each other such that the floating structure is engaged at two spaced apart tie down devices.

8. A rigid mooring device for engagement between a nonfloating structure and a floating structure, with the floating structure having a tie down device, with the rigid mooring device comprising:

a) a first structure having a proximal end and a distal end, with the proximal end having first and second proximal connections, with the first and second proximal connections being spaced apart from each other, with the first and second proximal connections being adapted to be connected to the nonfloating structure, with the distal end of the first structure having a distal connection and being adapted to be connected to the tie down device of the floating structure;

b) with the first structure being rigid from the first and second proximal connections to the distal connection; and c) wherein the first structure includes a first face and a second face, with the distal connection being on the second face, and with the first structure further comprising a release and a connection train between the release and the distal connection, with the distal connection including a latch, with the release, connection train and latch being structured such that operation of the release opens the latch and maintains the latch in an open position until operation of the release ceases, with the release being on the first face.

9. A rigid mooring device for engagement between a nonfloating structure and a floating structure, with the floating structure having a tie down device, with the rigid mooring device comprising:

a) a first structure having a proximal end and a distal end, with the proximal end having first and second proximal connections, with the first and second proximal connections being spaced apart from each other, with the first and second proximal connections being adapted to be connected to the nonfloating structure, with the distal end of the first structure having a distal connection, and with the distal connection having a through hole for accepting a portion of the tie down device of the floating structure, said through hole being formed by a hook and a latch that form a closed loop;

b) with the first structure being rigid from the first and second proximal connections to the distal connection, and with the first structure including a first piece that is integral and one-piece from the first proximal connection to the distal connection such that rigidity of said first structure is maximized;

c) wherein the first piece comprises said hook; and d) wherein the first structure further comprises said latch that closes off the hook to form said closed loop.

* * * * *